US012313336B2

(12) United States Patent
Trueba et al.

(10) Patent No.: US 12,313,336 B2
(45) Date of Patent: May 27, 2025

(54) METHOD FOR STARTING UP AN ARGON SEPARATION COLUMN OF AN APPARATUS FOR AIR SEPARATION BY CRYOGENIC DISTILLATION AND UNIT FOR IMPLEMENTING THE METHOD

(71) Applicant: L'Air Liquide, Societe Anonyme pour l'Etude et l'Exploitation des Procedes Georges Claude, Paris (FR)

(72) Inventors: Antonio Trueba, Paris (FR); David Bednarski, Paris (FR); Bernard Saulnier, Jouy-en-Josas (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 772 days.

(21) Appl. No.: 17/211,756

(22) Filed: Mar. 24, 2021

(65) Prior Publication Data

US 2021/0310730 A1 Oct. 7, 2021

(51) Int. Cl.
*F25J 1/00* (2006.01)
*F25J 3/04* (2006.01)

(52) U.S. Cl.
CPC ..... *F25J 1/0015* (2013.01); *F25J 1/002* (2013.01); *F25J 3/04412* (2013.01);
(Continued)

(58) Field of Classification Search
CPC ..... F25J 1/0015; F25J 1/002; F25J 3/04412; F25J 2210/42; F25J 2210/58;
(Continued)

(56) References Cited

U.S. PATENT DOCUMENTS 4,784,677 A * 11/1988 Al-Chalabi ..... F25J 3/04412 23/293 R
5,100,447 A * 3/1992 Krishnamurthy ..... F25J 3/0285 62/630

(Continued)

FOREIGN PATENT DOCUMENTS

EP 1 482 266 12/2004
FR 2716816 A1 * 9/1995 ..... F25J 3/04412

(Continued)

OTHER PUBLICATIONS

French Search Report for FR 2003289, mailed Nov. 17, 2020.

(Continued)

*Primary Examiner* — Jianying C Atkisson
*Assistant Examiner* — Ibrahim A. Michael Adeniji
(74) *Attorney, Agent, or Firm* — Justin K. Murray

(57) ABSTRACT

A unit for producing argon by cryogenic distillation, suitable for connection to a double air separation column consisting of first and second columns interconnected thermally, comprises an argon separation column surmounted with a top condenser and a denitrogenation column, means for withdrawing an argon-rich and nitrogen-depleted product (LAR) at the bottom of the denitrogenation column, means for connecting the top of the argon separation column to the denitrogenation column, means for sending a top gas from the argon separation column to the atmosphere, means for withdrawing a nitrogen-rich fluid from the top of the denitrogenation column, an analyser for measuring the nitrogen content at the top of the argon separation column, and means for opening and closing the means for connecting the top of the argon separation column to the denitrogenation column depending on the nitrogen content detected by the analyser.

7 Claims, 5 Drawing Sheets

(52) U.S. Cl.
CPC ..... *F25J 2210/42* (2013.01); *F25J 2210/58* (2013.01); *F25J 2215/04* (2013.01); *F25J 2250/20* (2013.01); *F25J 2280/10* (2013.01); *F25J 2290/00* (2013.01); *F25J 2290/60* (2013.01)

(58) Field of Classification Search
CPC .. F25J 2215/04; F25J 2250/20; F25J 2280/10; F25J 2290/00; F25J 2290/60; F25J 2235/58; F25J 2245/58; F25J 3/04678; F25J 3/04703; F25J 3/04727; F25J 3/048; F25J 3/04806; F25J 3/04818; F25J 3/04072; F25J 2215/58
See application file for complete search history.

(56) References Cited

U.S. PATENT DOCUMENTS 5,207,066 A * 5/1993 Bova ..... F25J 3/04351 62/924
5,313,800 A * 5/1994 Howard ..... F25J 3/04848 700/270
5,431,023 A * 7/1995 Howard ..... F25J 3/04418 62/656
5,505,051 A * 4/1996 Darredeau ..... F25J 3/04896 62/656
5,522,224 A * 6/1996 Canney ..... F25J 3/048 700/271
5,809,802 A * 9/1998 Rathbone ..... F25J 3/04678 62/646
5,970,743 A * 10/1999 Herron ..... F25J 3/04624 62/648
6,138,474 A * 10/2000 Smith, IV ..... F25J 3/04818 62/656
6,574,988 B1 * 6/2003 Saulnier ..... F25J 3/04963 62/648
7,204,101 B2 * 4/2007 Seiver ..... G05B 13/048 62/656
2003/0131625 A1 * 7/2003 Seiver ..... G05B 13/042 62/656
2005/0072187 A1 * 4/2005 Seiver ..... F25J 3/04848 62/643
2013/0053998 A1 * 2/2013 Singhal ..... F25J 3/04303 700/108
2020/0041204 A1 * 2/2020 Briglia ..... F25J 3/04927

FOREIGN PATENT DOCUMENTS

| | | |
|---|---|---|
| FR | 2 911 392 | 7/2008 |
| JP | S55 60164 | 5/1980 |
| JP | H07 133982 | 5/1995 |
| JP | 2008 057804 | 3/2008 |
| KR | 2003 0039585 | 5/2003 |
| KR | 10 19 64331 | 4/2019 |

OTHER PUBLICATIONS

MacConnell, M.H., "Chapter 8.37—Separation Controls, Air," Materias/Instrumentacion Industrial/Instrument Engineers' Handbook, Fourth edition, Volumn Two—Process Control and Optimization/1081ch8_37.pdf, Jan. 1, 2006, pp. 2123-2136.

* cited by examiner

[Fig. 1]
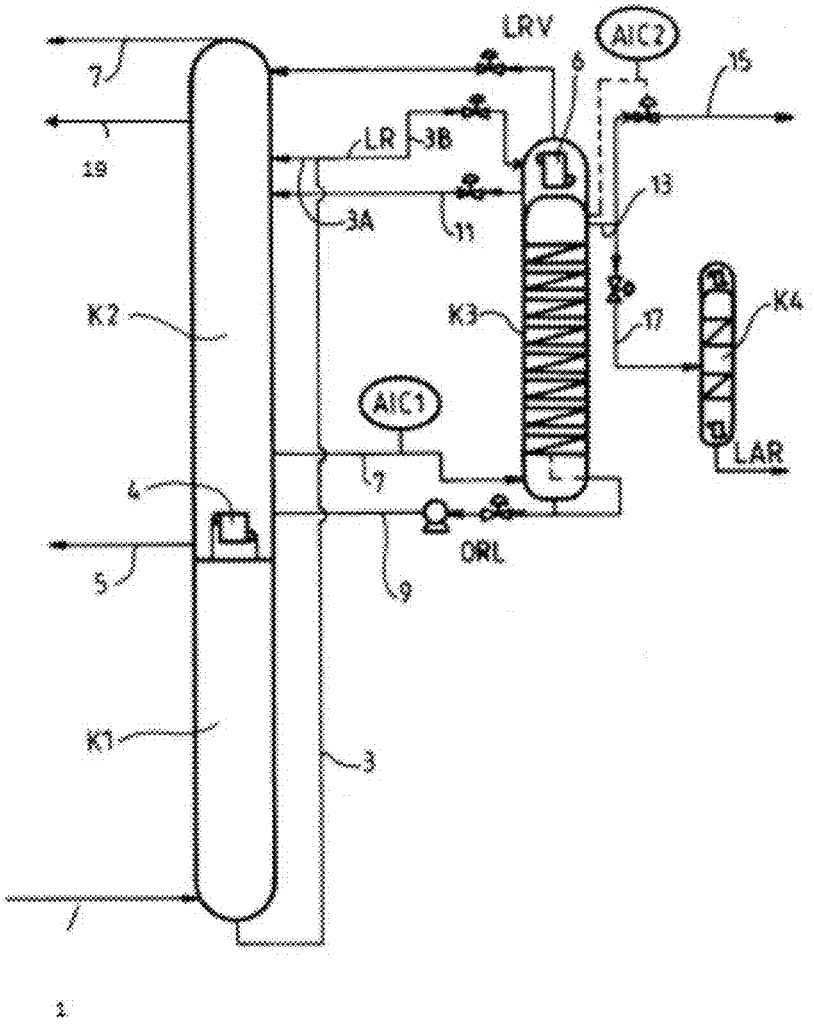

[Fig. 2]
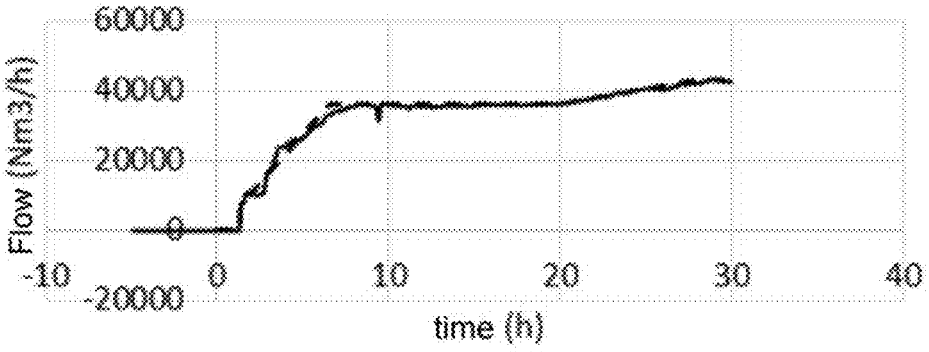
[Fig. 3]
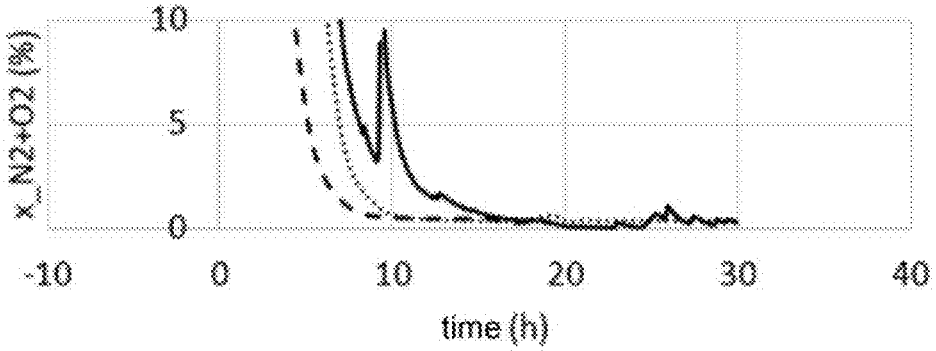

[Fig. 4]
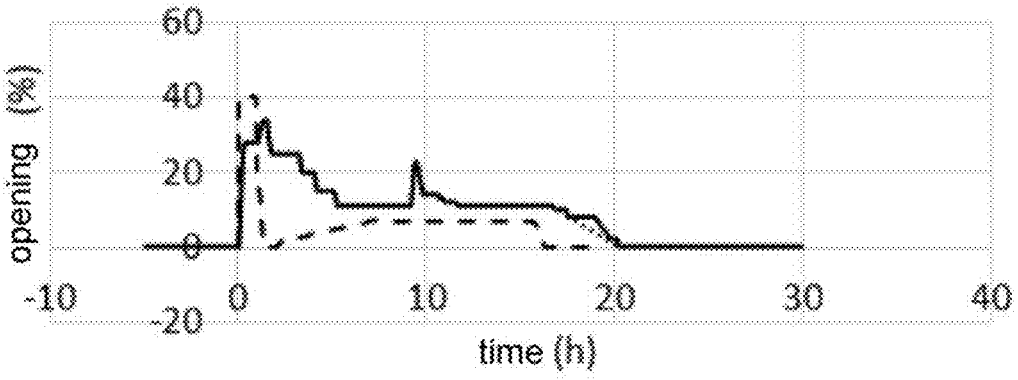
[Fig. 5]
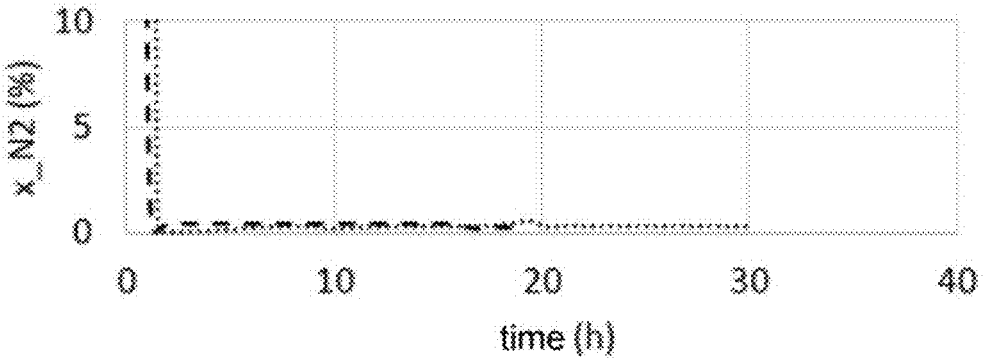

[Fig. 6]
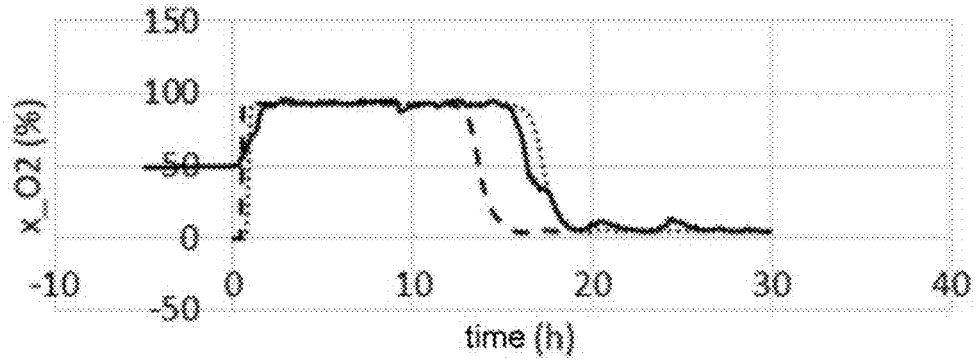
[Fig. 7]
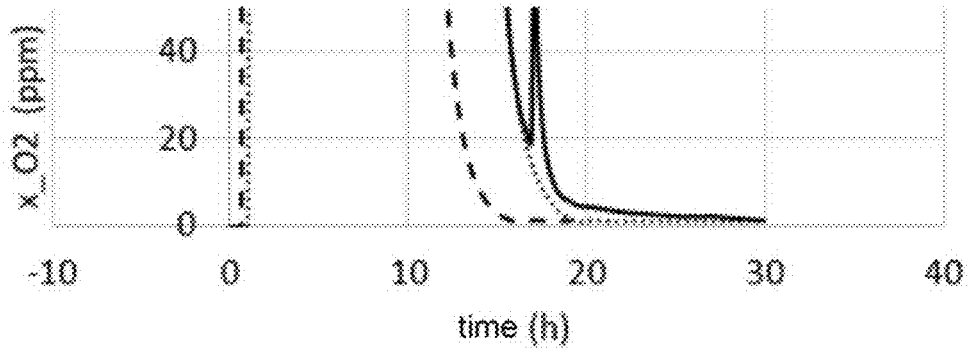

[Fig. 8]
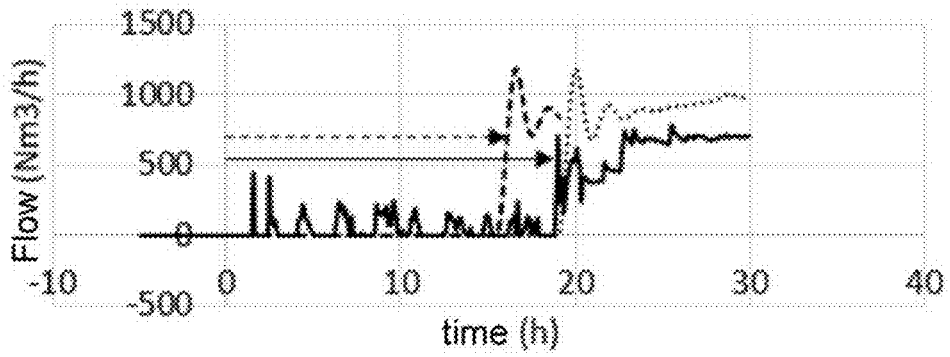

METHOD FOR STARTING UP AN ARGON SEPARATION COLUMN OF AN APPARATUS FOR AIR SEPARATION BY CRYOGENIC DISTILLATION AND UNIT FOR IMPLEMENTING THE METHOD

CROSS REFERENCE TO RELATED APPLICATIONS

This application claims the benefit of priority under 35 U.S.C. § 119 (a) and (b) to French patent application No. FR2003289, filed Apr. 2, 2020, the entire contents of which are incorporated herein by reference.

FIELD OF THE INVENTION

The present invention relates to a method for starting up an argon separation column of an apparatus for separating air by cryogenic distillation. It also relates to a unit which can be started up by this method.

More specifically, the field of application of certain embodiments of the present invention can be related to air separation units equipped with a cryogenic argon production system, i.e., with an impure argon column (for separation of argon and oxygen) and a pure argon column (also called denitrogenation column, for removing the nitrogen and so obtaining pure argon).

BACKGROUND OF THE INVENTION

The air separation apparatus to which certain embodiments of the invention pertain comprises a double column having a first column operating at a first pressure and a second column operating at a second pressure, lower than the first pressure. The second column is fed with a nitrogen-enriched liquid and an oxygen-enriched liquid coming from the first column. Because of the differences in relative volatility between argon, nitrogen and oxygen, virtually pure nitrogen is formed at the top of the second column, virtually pure oxygen is formed at the bottom of the second column, and argon-rich gas in the middle of the second column. An argon-enriched gas often termed crude argon is withdrawn from the second column and sent to an argon separation column having a top condenser. The crude argon is rectified to give an oxygen-rich reflux (which is subsequently sent to the second column) and a very argon-rich stream (often termed argon mixture) which no longer contains virtually any oxygen (the oxygen content in the argon mixture is typically less than 3 ppm of oxygen). This argon mixture is sent to a denitrogenation column in order to remove the nitrogen by reboiling. At the bottom of the denitrogenation column, pure argon is withdrawn in liquid form and is sent to a liquid argon storage facility.

The argon separation column (argon mixture column) may be in two parts in order to reduce the size of the cold box.

As described in FR2911392, at start-up, the denitrogenation column is not fed while the oxygen contents of the fluid extracted at the top of the argon separation column are not correct. During this period, the gas produced at the top of the argon separation column is sent to the air.

The method of FR2911392 proposed feeding the denitrogenation column during start-up even if the oxygen contents were unsatisfactory, and returning the bottom liquid from the denitrogenation column to the argon separation column.

EP1482266 shows the case in which the gas sent to the atmosphere during start-up is reheated in the main exchanger to recover the frigories. No explanation is given of how the sending of the gas is controlled.

KR10196331 proposes storing the argon produced at the top of the mixture column while the double column is not in operation.

There are also argon mixture columns whose function is not to yield an argon-rich product but solely to reduce the argon content of an oxygen-rich product from the double column. In this case, the flow withdrawn at the top of the column contains up to 10 mol % of oxygen, or even up to 15 mol % of oxygen.

The invention is also applicable to processes with production of gaseous or liquid argon.

SUMMARY OF THE INVENTION

The aim of the invention is to optimise and accelerate the start-up phase of an argon mixture column.

According to one subject of the invention, a unit is provided for producing argon by cryogenic distillation, suitable for connection to a double air separation column consisting of first and second columns interconnected thermally, comprising an argon separation column surmounted with a top condenser and a denitrogenation column, means for withdrawing an argon-rich and nitrogen-depleted product at the bottom of the denitrogenation column, means for connecting the top of the argon separation column to the denitrogenation column, means for sending a top gas from the argon separation column to the atmosphere, means for withdrawing a nitrogen-rich fluid from the top of the denitrogenation column, an analyser for measuring the nitrogen content at the top of the argon separation column and/or in a fluid withdrawn at the top of the argon separation column, and means for opening and closing:

i) the means for connecting the top of the argon separation column to the denitrogenation column, and/or
ii) the means for sending the top gas from the argon separation column to the atmosphere depending on the nitrogen content detected by the analyser.

According to another aspect of the invention, a unit is provided for producing argon by cryogenic distillation, suitable for connection to a double air separation column consisting of first and second columns interconnected thermally, comprising an argon separation column surmounted with a top condenser, a gaseous nitrogen withdrawal line connected to the second column and suitable for connection to a heat exchanger, means for connecting the top of the argon separation column to the line, means for sending a top gas from the argon separation column to the atmosphere, an analyser for measuring the nitrogen content at the top of the argon separation column and/or in a fluid withdrawn at the top of the argon separation column, means, capable of being controlled at start-up, for opening and closing the means for sending the top gas from the argon separation column to the atmosphere depending on the nitrogen content detected by the analyser, and means, capable of being controlled during start-up, for opening and closing the means for sending the top gas from the argon separation column to the atmosphere depending on the nitrogen content detected by the analyser.

The unit may comprise a double air separation column comprising a first column operating at a first pressure and a second column operating at a second pressure, the top of the first column being thermally connected to the bottom of the second column and comprising means for sending air to the first column, means for sending a nitrogen-enriched fluid and an oxygen-enriched fluid from the first column to the second column, optionally a further column, fed by a gas coming from an intermediate point of the second column, the argon separation column being connected for receiving a gas coming from an intermediate point of the second column, or a gas coming from the further column.

According to other, optional aspects of the invention:

- the analyser is also connected for measuring the nitrogen content in the argon-enriched gas sent to the argon separation column.
- the analyser is connected for measuring alternatively the nitrogen content in the argon-enriched gas and the nitrogen content at the top of the argon separation column.

According to another aspect of the invention, a method is provided for starting up a column for separating argon by cryogenic distillation, in which an argon-enriched fluid coming directly or indirectly from a double air separation column comprising a first column and a second column which are interconnected thermally is sent to an argon separation column (K3) in which, during start-up of the column:

i. if the nitrogen content at the top of the argon separation column is above a first threshold, the top gas from the argon separation column is sent to the atmosphere, and ii. if the nitrogen content at the top of the argon separation column is below a second threshold, lower than or equal to the first threshold, the top gas from the argon separation column is sent to a denitrogenation column for separation therein and an argon-rich fluid product is withdrawn from the denitrogenation column.

During start-up, if the nitrogen content at the top is above the first threshold, preferably no gas for separation is sent to the denitrogenation column or, where appropriate, to the line.

According to other, optional aspects:

- during start-up, if the nitrogen content at the top of the argon separation column is below the second threshold, no gas is sent from the top of the argon separation column to the atmosphere.
- the nitrogen content at the top of the argon separation column is measured by means of an analyser capable of analysing the concentration of nitrogen in a range from 10 ppm to 100% N2 in a mixture of oxygen, nitrogen and argon.

According to another aspect of the invention, a method is provided for regulating a separation apparatus comprising a method for starting up the apparatus as described above, in which:

- during start-up, the nitrogen content at the top of the argon separation column is measured with an analyser and other than at the start-up, the nitrogen content of a gas feeding the argon separation column is measured with the analyser;
- during start-up, the nitrogen content at the top of the argon separation column increases.

An analyser allowing measurement of the nitrogen in the oxygen and the argon would allow the degassing valve to be regulated in order to minimize the loss of argon during the start-up phase and therefore to accelerate said phase.

The main feature of the invention is to add a regulation loop on the degassing valve of the argon separation column, referred to as argon mixture column. By measuring the nitrogen concentration at the top of the mixture column with an analyser, it is possible to send a flow coming from the top of the mixture column to the atmosphere when the nitrogen concentration is above a threshold and to send the flow to a denitrogenation column as soon as the nitrogen concentration is below the threshold. Using this analyser, it is possible to analyse the concentration of nitrogen in a range from 10 ppm to 100% N2 in a mixture of oxygen and argon.

The main benefit is to minimize the losses of argon and to accelerate the start-up of the unit.

During the start-up phase, when the O2 concentration is high, the measurement for nitrogen produced at the top of the argon separation column is falsified by the presence of O2.

The uncondensables valve therefore remains open until the N2+O2 measurement is below a threshold. But the nitrogen is very quickly expelled from the column, and the only effect of the uncondensables valve being open is to prolong the start-up time.

In the method proposed, the degassing valve for the uncondensables is a valve which is regulated by the measurement of nitrogen concentration by means of a dedicated analyser.

With this configuration, the losses of argon during the start-up phase are substantially reduced. Moreover, this allows this phase to be automated for optimal start-up.

The gains in start-up time may be up to 25% depending on the type of start-up.

BRIEF DESCRIPTION OF THE DRAWINGS

Further features and advantages of the invention will become apparent from the description hereinafter of embodiments, which are given by way of illustration but without any limitation, the description being given in relation with the following attached figures:

FIG. 1 shows a unit according to the invention.

FIG. 2 shows the variation in a flow of vaporized rich liquid produced by the top condenser of the argon separation column over time with a simulation with manual use of the degassing valve compared with the case with regulation of the degassing valve according to the invention.

FIG. 3 shows the variation in the total percentage of nitrogen and oxygen in the top gas from the argon separation column over time, comparing the case of a simulation with manual use of the degassing valve and a case with regulation of the degassing valve according to the invention.

FIG. 4 shows the opening of the degassing valve over time, for the case of a simulation with manual use of the degassing valve and a case with regulation of the degassing valve according to the invention.

FIG. 5 shows the percentage of nitrogen in the top gas from the argon separation column over time, for the case of a simulation with manual use of the degassing valve and a case with regulation of the degassing valve according to the invention.

FIG. 6 shows the percentage of oxygen at the middle of the argon separation column over time, for the case of a simulation with manual use of the degassing valve and a case with regulation of the degassing valve according to the invention.

FIG. 7 shows the percentage of oxygen in the top gas from the argon separation column over time, for the case of a simulation with manual use of the degassing valve and a case with regulation of the degassing valve according to the invention.

FIG. 8 shows the flow of top gas from the argon separation column over time, for the case of a simulation with manual use of the degassing valve and a case with regulation of the degassing valve according to the invention.

DETAILED DESCRIPTION OF THE INVENTION

In FIG. 1, compressed air 1 is sent to the first column K1 of a double column comprising first and second columns K1, K2 which are superposed and in thermal communication with an oxygen/nitrogen exchanger 4 referred to as a vaporizer-condenser. In this exchanger 4, gaseous nitrogen from the first column K1 undergoes condensation while vaporizing the liquid oxygen from the bottom of the second column K2. In the first column K1, which operates at a first pressure, the nitrogen is separated from the air, creating oxygen-rich liquid 3 at the bottom of the column and nitrogen-rich liquid and vapour at the top of the first column. These products are extracted, and nitrogen-enriched liquid and oxygen-enriched liquid are sent separately from the first column K1 to the second column K2, which operates at a lower pressure than the first column. Virtually pure nitrogen 7 is formed at the top of the second column K2, impure nitrogen 19 is formed at an intermediate level of the second column K2, and virtually pure oxygen 5 is formed at the bottom of the column K2 and argon-rich gas at the middle of the column K2. At least some of these fluids are sent for reheating in a heat exchanger which is the venue of cooling of the air 1 intended for the column K1. The impure nitrogen line 19 is suitable for connection to a heat exchanger.

The central fraction ORG 7, rich in argon, often termed crude argon, is withdrawn from the low pressure column and feeds an argon separation column K3, which operates at substantially the same pressure as the second column K2, with the aim of ultimately producing argon. The first column K3 comprises a top condenser. The crude argon is rectified to give an oxygen-rich reflux ORL 9 (which is subsequently sent to the low pressure column K2) and an argon-enriched fluid 13.

The argon-enriched fluid 13,17, containing for example less than 3 ppm of oxygen, in liquid or gaseous form is sent to a denitrogenation column K4 comprising a bottom reboiler and a top condenser in order to remove the nitrogen by reboiling. At the bottom of the denitrogenation column K4, pure argon LAR is withdrawn in liquid form and is sent to a liquid argon storage facility (not depicted). A nitrogen-enriched flow is withdrawn at the top of the denitrogenation column K4.

The argon separation column K3 may consist of two columns, as depicted here, in order to reduce the size of the cold box, or may consist of a single column, as depicted in FIG. 1.

To regulate the operation of the denitrogenation column, if the nitrogen content at the top of the argon separation column is above a first threshold, the top gas from the argon separation column is sent to the atmosphere.

If the nitrogen content at the top of the argon separation column is below a second threshold, lower than or equal to the first threshold, the top gas from the argon separation column is sent to a denitrogenation column for separation therein and an argon-rich fluid product is withdrawn from the denitrogenation column.

The value of the first and second thresholds may be the same.

For example, on start-up of an argon separation column K3, the first action is to vent off the nitrogen-rich gas 15 formed at the top of the argon separation column by opening a degassing valve which is regulated by the nitrogen level measured by the analyser AIC2. The analyser AlC2 is able to analyse the concentration of nitrogen in a range from 10 ppm to 100% nitrogen in a mixture of oxygen, nitrogen and argon. The analyser AIC2 measures the nitrogen content at the top of the column K3 and/or in a fluid 15 withdrawn at the top of the argon separation column K3. The analyser does not necessarily analyse the gas to be sent to the atmosphere, but may analyse another fluid whose nitrogen content is indicative of that of the flow 15.

As start-up progresses, the gas 15 becomes increasingly less nitrogen-rich and increasingly more argon-rich. When the nitrogen concentration drops to 0.5 mol %, the venting of the gas 15 is halted, the degassing valve is closed, and the gas is sent as flow 17 to the denitrogenation column K4 by opening a valve to the denitrogenation column K4.

As long as the nitrogen concentration measured by the analyser AlC2 at the top of the argon separation column K3 is above a threshold, for example 0.5 mol %, the flow 15 is vented off through the open degasssing valve. As soon as the nitrogen concentration passes beneath the threshold, venting is halted and the flow 17 is sent to an intermediate level of the denitrogenation column K4 to produce pure argon at the bottom of the column K4.

For simplifying the apparatus and for reducing instrumentation costs, an analyser AIC1 may be used to measure the nitrogen in a fluid, for example the top gas, from the argon separation column K3 during start-up and to measure the nitrogen in the gas feeding the argon separation column K3 during normal operation of the argon separation column K3. The analyser AlC1 is able to analyse the concentration of nitrogen in a range from 10 ppm to 100% N2 in a mixture of oxygen, nitrogen and argon.

It is also possible for the analyser AlC1 alternatively to analyse the flow 7 and a fluid, for example the top gas 15, from the column K3 to measure the nitrogen content thereof. It may therefore analyse the flow 7 and the top gas 15 during start-up and/or analyse the flow 7 and the top gas 15 during normal operation.

For simplifying the apparatus and for reducing instrumentation costs, an analyser AIC1 may be used to measure the nitrogen in the top gas from the argon separation column K3 during start-up and to measure the nitrogen in the gas feeding the argon separation column K3 during normal operation of the argon separation column K3. The analyser AlC1 is able to analyse the concentration of nitrogen in a range from 10 ppm to 100% N2 in a mixture of oxygen, nitrogen and argon.

It is also possible for the analyser AlC1 alternatively to analyse the flow 7 and the top gas from the column K3 to measure the nitrogen content thereof. It may therefore analyse the flow 7 and the top gas during start-up and/or analyse the flow 7 and the top gas during normal operation.

It will be appreciated that the apparatus according to the invention may form a separate module of the double column, to be built and assembled and then sent to site to be connected to the double column. The column K3 and the column K4 if present may be isolated by a cold box independent from that of the double column.

It will be appreciated that the column K3 may be in two sections, one forming the lower part of the column K3 and the other the upper part with the condenser 6.

In certain cases, for each variant of [FIG. 1] it may be sufficient to have either means for opening and closing the means for connecting the top of the argon separation column to the denitrogenation column depending on the nitrogen content detected by the analyser or means for opening and closing the means for sending a top gas from the argon separation column to the atmosphere depending on the nitrogen content detected by the analyser.

The argon separation column K3 may be connected for receiving a gas 7 coming from an intermediate point of the second column or a gas coming from a column fed by the gas coming from an intermediate point of the second column.

[FIG. 2] shows the case of a simulation with manual use of the degassing valve venting off the gas 15 and a case with regulation of the degassing valve according to the invention. [FIG. 2] shows the variation in a flow of vaporized rich liquid produced by the top condenser of the argon separation column over time with a simulation with manual use of the degassing valve compared with the case with regulation of the degassing valve according to the invention. For all the figures from FIG. 2 on, the solid line indicates actual data from an apparatus, the dashes the simulation according to the invention, and the dots the simulation according to the prior art.

It can be seen for FIG. 2 that the flow increases in both cases.

[FIG. 3] shows the variation in the total percentage of nitrogen and oxygen in the top gas from the argon separation column over time, comparing the case of a simulation with manual use of the degassing valve and a case with regulation of the degassing valve according to the invention. Here it is seen that the nitrogen and oxygen concentrations can be reduced much more quickly with the invention.

[FIG. 4] shows the opening of the degassing valve over time, for the case of a simulation with manual use of the degassing valve and a case with regulation of the degassing valve according to the invention.

[FIG. 5] shows the percentage of nitrogen in the top gas from the argon separation column over time, for the case of a simulation with manual use of the degassing valve and a case with regulation of the degassing valve according to the invention.

[FIG. 6] shows the percentage of oxygen at the middle of the argon separation column over time, for the case of a simulation with manual use of the degassing valve and a case with regulation of the degassing valve according to the invention. It is seen that the oxygen can be reduced more quickly with the invention.

[FIG. 7] shows the percentage of oxygen in the top gas from the argon separation column over time, for the case of a simulation with manual use of the degassing valve and a case with regulation of the degassing valve according to the invention. It is seen that the oxygen can be reduced more quickly with the invention.

[FIG. 8] shows the flow of top gas from the argon separation column over time, for the case of a simulation with manual use of the degassing valve and a case with regulation of the degassing valve according to the invention.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

What is claimed is:

1. A method for starting up a column for separating argon by cryogenic distillation, the method comprising the steps of:

sending an argon-enriched fluid coming directly or indirectly from a double air separation column to an argon separation column, wherein the double air separation column comprises a first column and a second column, which are interconnected thermally;

measuring a nitrogen content at a top of the argon separation column, wherein during start-up of the column:

a. sending a top gas from the argon separation column to the atmosphere, upon a determination that the nitrogen content at the top of the argon separation column is above a first threshold, and b. sending the top gas from the argon separation column to a denitrogenation column for separation therein upon a determination that the nitrogen content at the top of the argon separation column is below a second threshold, which is lower than or equal to the first threshold; and withdrawing an argon-rich fluid product from the denitrogenation column.

2. The method according to claim 1, wherein during start-up, upon a determination that the nitrogen content at the top of the argon separation column is above the first threshold, the method further comprises the step of sending no gas for separation to the denitrogenation column.

3. The method according to claim 1, wherein during start-up, upon a determination that the nitrogen content at the top of the argon separation column is below the second threshold, the method further comprises the step of sending no gas from the top of the argon separation column to the atmosphere.

4. The method according to claim 1, wherein the nitrogen content at the top of the argon separation column is measured by means of an analyzer configured to analyze the concentration of nitrogen in a range from 10 ppm to 100% $N_2$ in a mixture of oxygen, nitrogen and argon.

5. The method according to claim 1, wherein the second threshold is lower than the first threshold.

6. The method according to claim 1, wherein the second threshold is equal to the first threshold.

7. A method for regulating a separation apparatus comprising a method for starting up the apparatus according to claim 1, wherein during start-up, the method comprises measuring the nitrogen content at the top of the argon separation column with an analyzer, and operating phases other than at the start-up, measuring the nitrogen content of a gas feeding the argon separation column with the analyzer.

* * * * *